US007234463B2

(12) United States Patent
Jacob

(10) Patent No.: US 7,234,463 B2
(45) Date of Patent: Jun. 26, 2007

(54) PERIPHERY VIEW GOGGLE AND REMOTE BREATHING ASSEMBLY

(76) Inventor: William Joseph Jacob, 10904 Indiana Ave., Kansas City, MO (US) 64137

( * ) Notice: Subject to any disclaimer, the term of this patent is extended or adjusted under 35 U.S.C. 154(b) by 534 days.

(21) Appl. No.: 10/675,288

(22) Filed: Sep. 30, 2003

(65) Prior Publication Data

US 2005/0066967 A1 Mar. 31, 2005

(51) Int. Cl.

| | |
|---|---|
| ***B63C 11/02*** | (2006.01) |
| ***B63C 11/16*** | (2006.01) |
| ***A62B 18/02*** | (2006.01) |
| ***A61F 9/02*** | (2006.01) |

(52) U.S. Cl. ..... 128/201.27; 128/201.11; 128/205.25; 2/426; 2/428; 2/430

(58) Field of Classification Search ..... 128/205.25, 128/206.12, 206.13, 206.21, 206.23, 206.24, 128/206.27, 206.28, 201.11, 201.12, 201.27, 128/202.11, 201.29; 2/9, 428, 430, 431, 2/209, 423; 351/43; 405/185, 186

See application file for complete search history.

(56) References Cited

U.S. PATENT DOCUMENTS

| | | | | |
|---|---|---|---|---|
| 1,742,412 | A | 1/1930 | O'Flanagan | |
| 2,182,104 | A * | 12/1939 | Wilen et al. | 2/440 |
| 2,317,236 | A | 4/1943 | Wilen et al. | |
| 2,317,237 | A | 4/1943 | Wilen | |
| 2,909,959 | A | 10/1959 | Girden | |
| 4,755,040 | A | 7/1988 | Haslbeck | |
| 4,912,777 | A * | 4/1990 | Gasbarro | 2/2.15 |
| 5,066,022 | A | 11/1991 | Harrington | |
| 5,191,363 | A | 3/1993 | Smith et al. | |
| 5,313,671 | A | 5/1994 | Flory | |
| 5,390,373 | A | 2/1995 | Flory | |
| 5,421,037 | A * | 6/1995 | Schulze | 2/452 |
| 5,524,611 | A * | 6/1996 | Fu | 128/201.11 |
| 5,608,920 | A * | 3/1997 | Oliver et al. | 2/428 |
| 5,697,362 | A | 12/1997 | Albrecht | |
| 6,152,137 | A | 11/2000 | Schwartz et al. | |
| 6,341,863 | B1 * | 1/2002 | Chen-Lieh | 351/43 |
| 6,588,899 | B2 * | 7/2003 | Pierotti | 351/159 |
| 6,668,823 | B1 * | 12/2003 | Liu | 128/201.11 |
| 6,921,164 | B2 * | 7/2005 | Morgan et al. | 351/43 |

* cited by examiner

*Primary Examiner*—Justine R. Yu
*Assistant Examiner*—Amadeus Lopez
(74) *Attorney, Agent, or Firm*—Jacob & Associates, LLC

(57) ABSTRACT

A remote breathing assembly includes a periphery viewable goggle, an air-tube, and a remote breathing apparatus. The goggle includes a transparent lens having a front section that defines a lateral front length, and left and right sections that extend transversely from the front section a minimum length. The goggle further includes a compressible liner, a liner interface and securing means for fixing the goggle relative to a wearer's face. The air-tube presents upper and lower ends. The lower end is coaxially aligned with an opening defined by the lens and sealably attached to the goggle. The apparatus is removably coupled to the air-tube near the upper end, and retains the upper end in a fixed position relative to the lower end.

16 Claims, 4 Drawing Sheets

PERIPHERY VIEW GOGGLE AND REMOTE BREATHING ASSEMBLY

BACKGROUND OF THE INVENTION

1. Field of the Invention

The present invention relates generally to protective eyewear, and more particularly to a viewing goggle improved to protect the eyes, nose and ears of a wearer from externalities, and configured to expose the wearer to conditions at a remote location.

2. Discussion of the Prior Art

Conventional goggles have been developed to protect the eyes of a wearer while performing hazardous activities. Conventional goggles typically comprise a frame, at least one transparent lens coupled to the frame, and means for securing the frame and lens to the face of the wearer during use. For some activities, such as swimming, the goggle provides an airtight chamber between the lens and the wearer's face.

Conventional goggles, however, present problems and disadvantages. For example, conventional goggle frames at least partially obscure the peripheral, upward and downward vision of the wearer. Another problem is the lack of protection typically afforded by these goggles to other parts of the wearer's face, such as the nose and ears, where it is appreciated that exposing these organs to certain fluids, fluid-borne particles, or microorganisms can cause illness or discomfort to the wearer. Yet another problem is presented by the circumscribing edge of conventional swim goggles, which are often required to be uncomfortably and sometimes painfully compressed against the soft tissues of the wearer's face in order to provide the air-tight chamber.

Finally, conventional goggles do not address the long-felt problems associated with the inability of humans to breathe underwater. Other conventional devices, such as snorkeling equipment, have been developed that expose underwater swimmers to ambient air conditions above the water surface. However, these devices problematically require the user to breathe through his or her mouth and manually maintain an open airway, while swimming at a proper depth under the water surface. Other devices have also been developed that facilitate underwater nasal breathing, such as Scuba diving equipment, however, these devices are generally too expensive, complex and simply inappropriate for most residential swimming pools and at shallow coastal depths.

SUMMARY OF THE INVENTION

Responsive to these and other problems, the present invention concerns an improved goggle for protecting the eyes, nose, and ears of a wearer, while not obstructing his or her forward, upward, downward and peripheral vision. The invention provided hereof, among other things, is useful for preventing illness and discomfort that can result from exposure to and retention of fluids, fluid-borne particles and microorganisms in these regions. The invention is also useful for intercommunicating an otherwise airtight chamber and ambient air conditions located at a remote breathing apparatus coupled to the goggle.

A first aspect of the invention concerns a periphery viewable goggle for protecting a portion of a wearer's face from externalities. The goggle includes a flexible lens having transparent front, left and right sections. The front section defines a lateral front length, and the left and right sections each extends transversely from the front section and presents a length not less than one-eighth of the lateral front length. The goggle also includes a compressible liner attached to the lens, wherein the liner is configured to form a seal between the lens and the wearer's face. Finally, the goggle includes a securing element for securing the lens in a fixed position relative to the wearer's face, and compressing the liner, so as to form an airtight chamber between the lens and the portion of the wearer's face.

A second aspect of the invention concerns a remote breathing assembly for protecting a portion of a wearer's face from externalities and exposing the portion to conditions at a remote location. The assembly includes a goggle defining an orifice, and configured to form an otherwise airtight chamber adjacent the portion. The assembly also includes a flexible air tube presenting a first end that is coaxially aligned with the orifice and sealably attached to the goggle, and a second end. Finally, the assembly includes a remote breathing apparatus that is coupled to the air tube and spaced from the first end. The apparatus is operable to retain the second end in a generally fixed position relative to the first end.

A third aspect of the invention recites a method for protecting a portion of a person's face including the eyes and nose from externalities, while enabling the periphery vision of the person and exposing the person to conditions at a remote location. The method comprises multiple steps. First, a protective goggle having a transparent lens is positioned adjacent the portion of the person's face, wherein the lens defines an orifice. Second, the goggle is spaced from the person's face with compressible lining so that the lining generally defines a continuous line of contact partially extending generally along the person's brow and below the person's nose. Third, the goggle is secured against the person's face and the liner is compressed so as to present a fixed airtight chamber adjacent the person's nose. Finally, one end of an air tube is coaxially aligned with the orifice and sealably attached to the lens, while the other end is removably coupled to a remote location, so as to intercommunicate the chamber and the conditions at the remote location.

Other aspects and advantages of the present invention will be apparent from the following detailed description of the preferred embodiment and the accompanying drawing figures.

DETAILED DESCRIPTION OF THE PREFERRED EMBODIMENTS

Figure 1B:
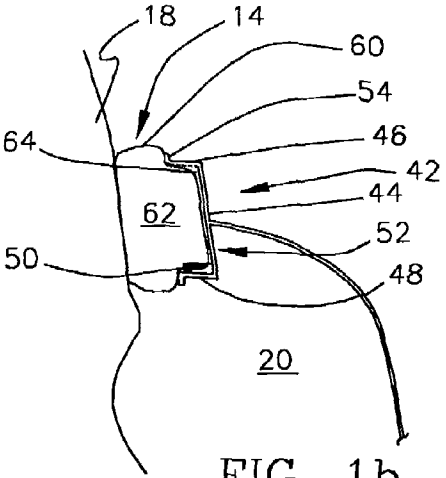
FIG. 1*b* is a fragmentary cross-sectional view of the goggle shown in FIG. 1, particularly illustrating the liner interface.
Figure 1A:
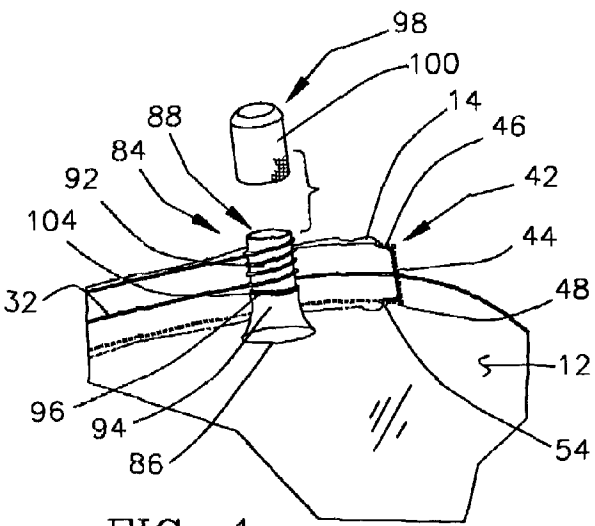
FIG. 1*a* is an enlarged fragmentary exploded view of the goggle shown in FIG. 1, particularly illustrating the air-tube stub.
Figure 1:
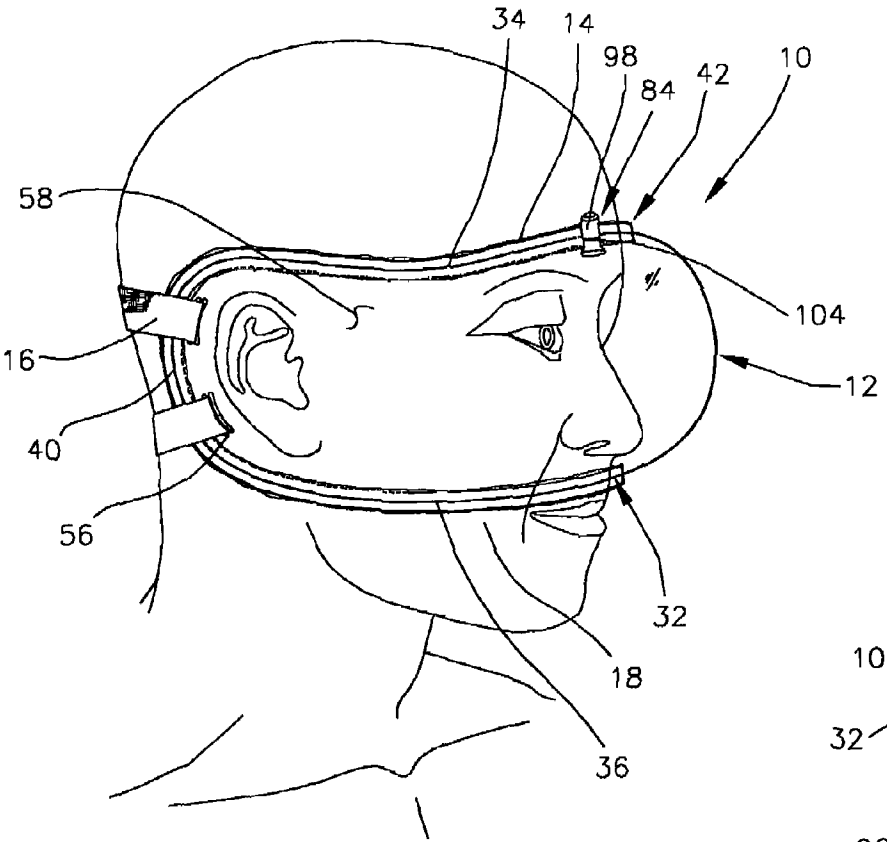
FIG. 1 is a perspective view of a preferred embodiment of the periphery view goggle being donned by a human wearer.

Turning first to FIGS. 1, 1*a* and 1*b*, an embodiment of the present invention includes a periphery view goggle 10 comprising a transparent U-shaped lens 12, a compressible liner 14 adhesively attached to the lens 12, and at least one strap 16 attached to the lens 12 for securing the goggle 10 and compressing the liner 14 against the face 18 of a human wearer. The protective goggle 10 is configured to cooperatively define an airtight chamber 20 between the lens 12 and that portion of the wearer's face 18 covered by the lens 12. The liner 14 is configured to form a seal between the lens 12 and the wearer's face 18, thereby, preventing the exposure of the covered portion of the wearer's face 18 to externalities, such as fluids, fluid-borne particles and microorganisms. Preferably, the encapsulated portion of the wearer's face 18 includes the nose, eyes and ears of the wearer, and the transparency of the lens 12 enables the wearer to maintain unobstructed vision in the forward, upward, downward and peripheral directions.

Figure 2:
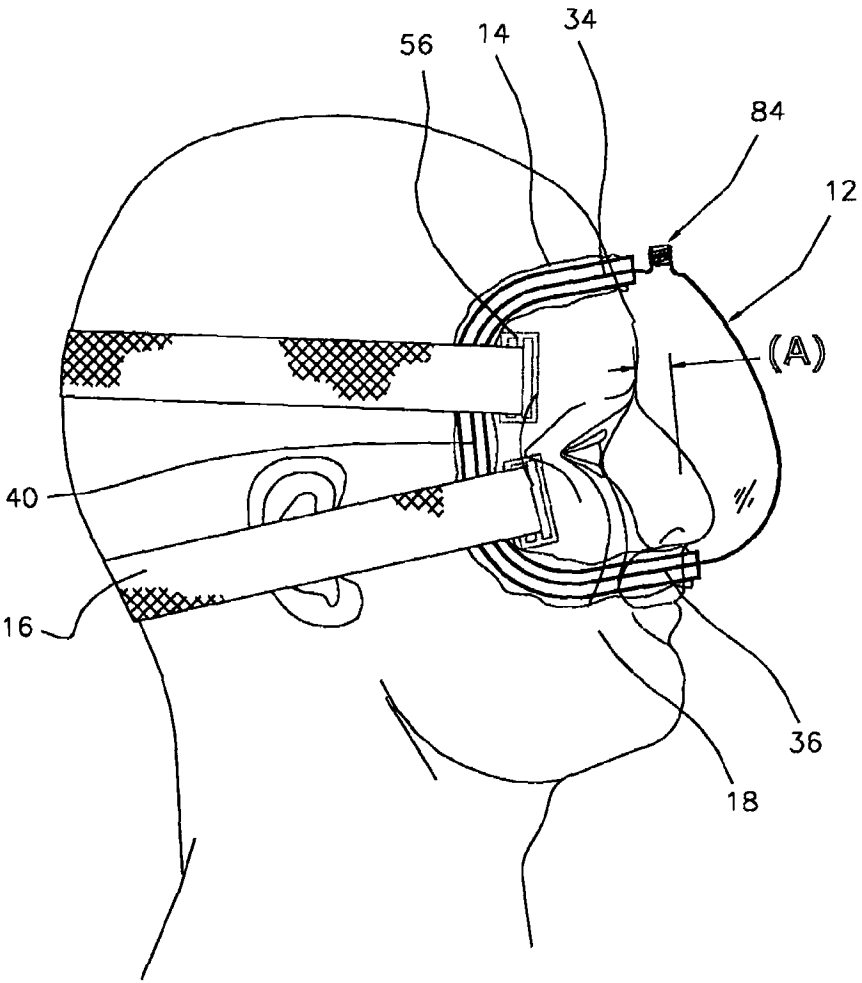
FIG. 2 is a side elevational view of a preferred embodiment of the periphery view goggle being donned by a human wearer, particularly illustrating the half teardrop shaped vertical cross-section.

The lens 12 preferably includes a unitary flexible body having a U-shaped horizontal cross-section and an arcuately shaped vertical cross-section. Alternatively, however, where a more streamline profile is desired to reduce drag, the lens 12 can present a half teardrop shaped vertical cross-section, as shown in FIG. 2. The arcuate shaped vertical cross-section of the lens 12 is sufficient to enable the entry of the median size nose and ears of a human wearer within a particular group size, i.e. small, medium, large, etc. More preferably, the lens 12 is configured so as to be able to retain up to 125% of the median size nose and ears of a human wearer within the particular group size. Most preferably, the lens 12 is custom fit to a particular human wearer.

Figure 3:
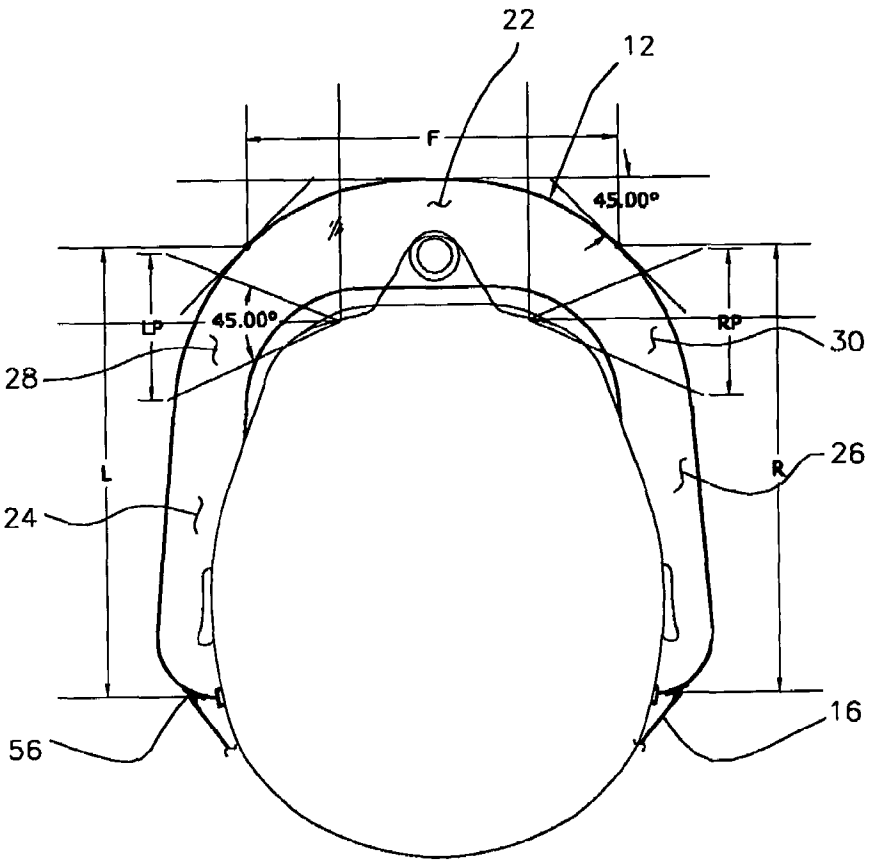
FIG. 3 is a plan view of the goggle shown in FIG. 1.

As best shown in FIG. 3, the preferred lens 12 presents a transparent front section 22 that extends across the wearer's face 18 a lateral front length, F, and transverse left and right sections 24,26. More preferably, the left and right sections 24,26 extend perpendicularly along the sides of the wearer's head, and eliminate from the front section 22 at points along the horizontal curvature of the lens 12 where horizontal tangents defined by the points form a forty-five degree angle with the horizontal tangents defined by the vertical mid-line of the front section 22 (see FIG. 3).

The left and right sections 24,26 include transparent left and right sub-sections 28,30 respectively. The subsections are adjacent the front section 22 and configured so as not to obstruct the wearer's vision in the general left and right peripheral directions LP,RP, wherein the peripheral directions LP,RP are generally defined as the forty-five degree horizontal angles bisected by perpendiculars to the wearer's forward vision (see FIG. 3). To enable full periphery vision, the subsections present lengths, L and R, that are not less than one-eighth of the lateral length, F, of the front section 22. Finally, the preferred front section 22, and left and right sub-sections 28,30 are integrally formed to present a seamless transparent lens 12.

Figure 6:
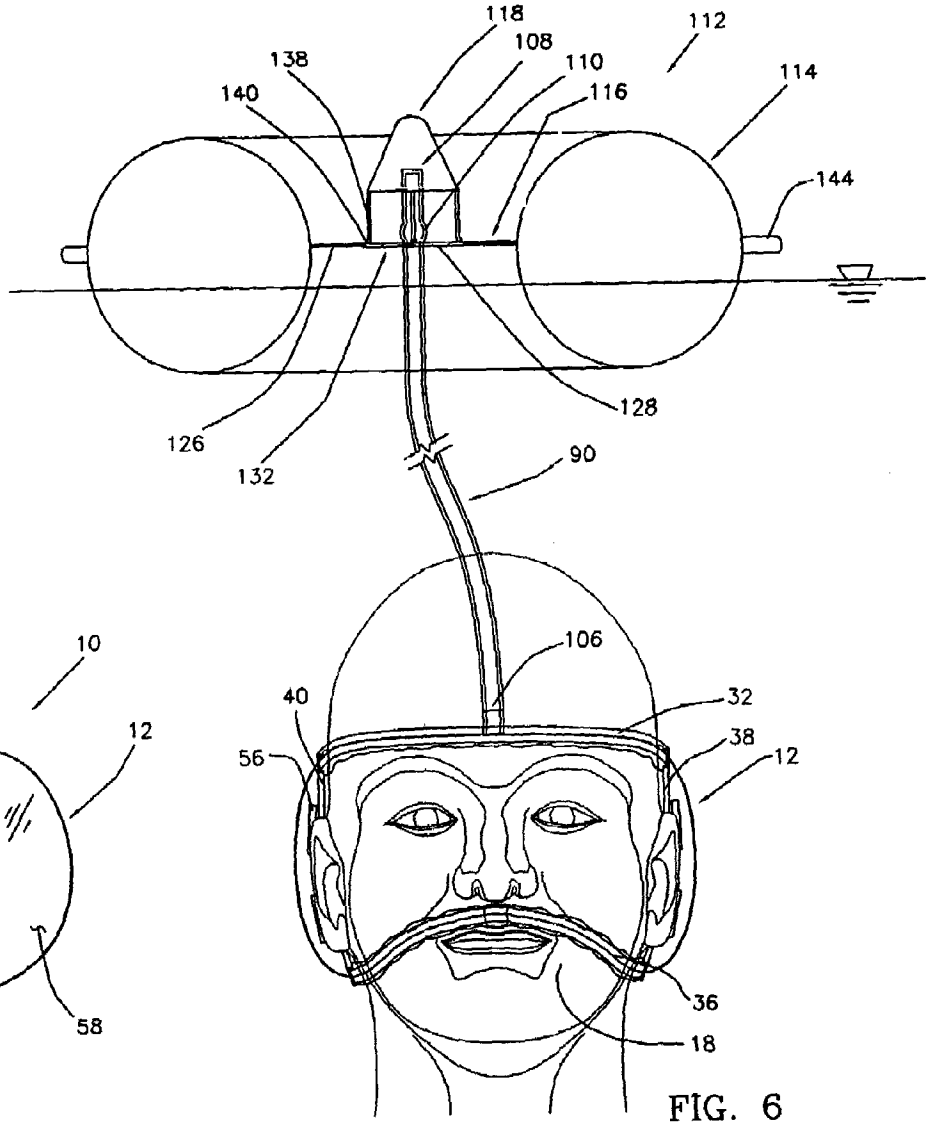
FIG. 6 is an elevational view of the remote breathing assembly, particularly illustrating the goggle being donned by a human wearer, an air-tube attached to the goggle, and a preferred embodiment of the remote breathing apparatus.

As best shown in FIGS. 1 and 6, the lens 12 defines a circumscribing edge 32 that includes generally top, bottom, left and right edges 34–40. When the goggle 10 is donned, the top edge 34 generally extends along the wearer's brow or forehead and along the sides of the wearer's head towards a point spaced above the wearer's ears. The bottom edge 36 generally extends below the wearer's eyes and the sides of the wearer's head towards a point spaced below the wearer's ears. More preferably, the bottom edge 36 generally extends below the nose of the wearer. A horizontal offset, A, is provided between the top edge 34 and bottom edge 36 to facilitate a more comfortable and uniform application of compressive force to the liner 14 (see FIG. 2). More preferably, the offset, A, is set within the range of one-quarter to three-quarter inches. The left and right edges 38,40 present generally arcuate shapes that preferably extend behind the wearer's left and right ears from said points spaced above and below the ear. Thus, the left and right edges 38,40 interconnect the top and bottom edges 34,36. It is within the ambit of the present invention, however, for the left and right edges 38,40 to extend in front of the wearer's ears, as shown in FIG. 2, where protection of the ears is not desired.

As best shown in FIG. 1*b*, the lens 12 includes a liner interface 42 that coextensively extends along the circumscribing edge 32. The interface 42 functions to provide a surface for securely attaching the compressible liner 14 to the lens 12 and for applying a broad compressive force to the liner 14. More preferably, the interface 42 presents a channel having a U-shaped configuration. The U-shaped channel is open towards the wearer's face 18, and includes a transverse panel 44 connecting two parallel side panels 46,48. The panels 44–48 cooperatively present inner and outer surfaces 50,52. The interface 42 is preferably affixed to the circumscribing edge 32 along the mid-line of the transverse panel 44. The interface 42 is adhesively attached to the liner 14 adjacent the inner surface 50 of the channel. To apply a broader compressive force, the side panels 46,48 preferably include flaps 54 that project perpendicularly outward from their unattached ends. The flaps 54 preferably present curved edges so as not to damage the liner 14 when the liner 14 is compressed.

As previously mentioned, at least one strap is coupled to the lens 12 to maintain the airtight chamber 20. More preferably, a plurality of stirrups 56 is configured to receive a plurality of straps 16, and the stirrups 56 are permanently fixed to the lens 12 by a commercially available high strength and waterproof adhesive (see FIG. 2). The bond formed by the adhesive is of sufficient strength to resist the shear stress applied by the straps under normal use. Most preferably, the stirrups 56 are integrally formed on the outer surface 58 of the lens 12. It is within the ambit of the present invention, however, for the strap ends to be integrally formed within or bonded directly to the lens 12, and for utilizing alternative structures for coupling the strap ends to the lens 12.

Turning to the construction of the lens 12, the lens 12 including the liner interface 42 is formed using conventional methods commonly known in the art, such as injection molding. For example, thermoplastic molding of a commercially available sufficiently transparent, non-brittle and lightweight polymer resin, such as a polypropylene or acrylic blend can be utilized. After molding, the goggles can be conveyed through ionized air to reduce static attraction of dust and dirt prior to dip coating with an abrasion resistant, anti-fog or tinted material commonly known in the art. More preferably, the selected resin produces an abrasion resistant, anti-fog and reflective or slightly tinted lens 12.

One of a plurality of mold designs varying in dimension provides a cast for each mold. For example, for adult sizes, twelve, fourteen and sixteen inch total lens lengths can be provided, wherein the total lens length is equal to the length of the top edge 34. These sizes further present four, four and one-half, and five inch lens heights respectively, where the lens height is vertically measured from the midpoints of the top and bottom edges 34,36, and preferably along the vertical centerline of the lens 12. More preferably, a mold can be formed according to an individual wearer's specified dimensions utilizing industry standard CAD/CAM or AutoCAD software.

The preferred lens 12 is integrally formed, including the stirrups 56 and interface 42, to present a unitary body. However, it is within the purview of the present invention to compile the lens 12 using separately constructed sections. For example, a transparent unitary body including the front section 22 and left and right sub-sections 28,30 could be sealably affixed to more durable rubber coated side sections to complete the lens 12.

As best shown in FIGS. 1–2, a compressible liner 14 forms a sealable barrier between the lens 12 and the wearer's face 18. The liner 14 preferably includes an outer membrane 60 and interstitial material 62. The membrane 60 forms an endless flexible tube having a circular cross-sectional shape, and is sufficiently sized so that a portion of the membrane 60 is able to form a superjacent relationship with the inner surface 50 of the liner interface 42. More preferably, the tube presents a diameter approximately equal to two times the inside width of the liner interface 42 as measured by the perpendicular distance between the parallel side panels 46,48.

The membrane 60 is preferably impervious to and insoluble in both fresh and sea water, but permeable to oxygen and water vapour. The membrane 60 is also impermeable to microorganisms. One such suitable material 62 is commercially available as Tegaderm RTM HP Transparent Wound Dressing produced by 3M, and comprises a thin polyurethane membrane 60 coated with a layer of an acrylic adhesive. Alternatively, other commercially available thin flexible materials that are impervious to water, such as a rubber or plastic liner, may be utilized. Finally, all seams or ribs presented by the tubular configuration of the membrane 60 are preferably oriented towards the liner interface 42, so as to present seamless contact with the wearer's face 18.

The preferred interstitial material 62 is a compressible fluid mass, i.e. a urethane or soft silicone gel, that is able to conform to the inside dimensions of the liner interface 42. The material 62 displaces only a portion of the inside volume of the membrane 60 so as to enable the material 62 to flow therein. In order to further enhance viewability the preferred interstitial material 62 is also transparent. However, the material 62 may be fluorescent, so as to be viewable in darkness.

Alternatively, the membrane 60 and material 62 of the liner 14 may be integrally formed of gelatinous material 62 as disclosed in U.S. Pat. No. 6,152,137 incorporated by reference herein. Other materials such as flowable rubber and self-retained silicone elastomers could also be utilized.

The outer membrane 60 of the liner 14 is attached to the inner surface 50 of the interface 42 by an adhesive strip 64 which bonds the two together and preferably forms an airtight seal therebetween. The adhesive strip 64 presents a water insoluble layer and a bonding contact area sufficient to provide a constant bond between the liner 14 and interface 42 under normal use. More preferably, the strip 64 coextensively extends along the entire inner surface 50 of the liner interface 42. An example of suitable adhesive strip material is available as part no. 80242 (ss-h) under the brand name Silicone Sealer, by Duro. However, other suitable commercially available waterproof adhesives, such as super glue, may also be utilized.

Alternatively, an impervious head mask (not shown) defining an opening adjacent the wearer's eyes and nose can initially be donned to facilitate the formation of a seal between the liner and the wearer's face.

Figure 4:
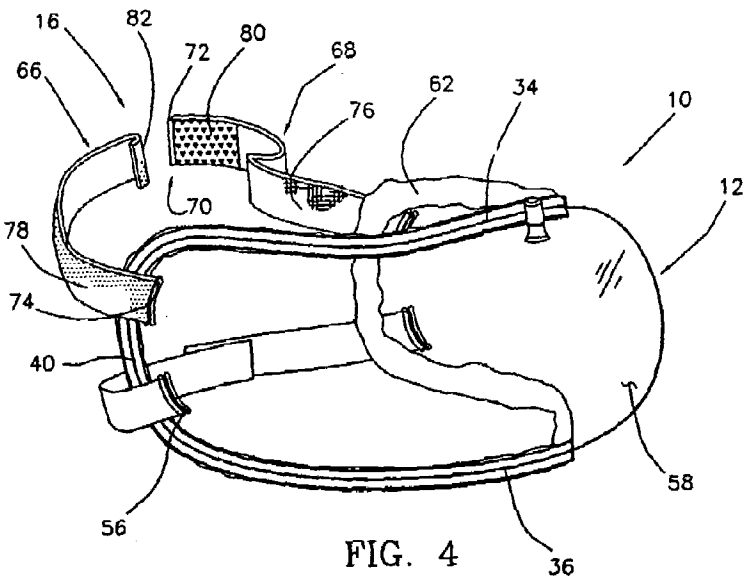
FIG. 4 is a perspective view of the goggle shown in FIG. 1, particularly illustrating the straps.

In the illustrated embodiment shown in FIGS. 1, 2 and 4, two straps 16 are coupled to the lens 12 to secure the goggle 10 and form an airtight chamber 20 adjacent the wearer's face 18. Each of the straps 16 preferably presents two strap sections 66,68, and an adjustable self-fastening mechanism 70 coupled thereto. Each section defines free and attached ends 72,74 relative to the goggle 10, and inner and outer surfaces 76,78 relative to the wearer's head. Alternatively, each strap 16 presents a single unitary band having two adjustably fastenable ends, wherein one end is received through the stirrups prior to being doubled over to fastenably engage the opposite unreceived end.

At least one of the straps 16 is preferably formed of stretchable material. More preferably, at least one of the straps 16 is formed of an elastic material comprising a spandex core polyester yarn or interwoven spandex filaments. However, any suitable commercially available non-degradable elastic strap can be utilized.

In the illustrated embodiment, the self-fastening mechanism 70 includes hook and loop patches 80,82 that are affixed to the straps 16 and able to interconnect when brought to bear against one another. The hook and loop patches 80,82 present a total grab strength along a contact plane that is sufficient to withstand the anticipated shearing stresses encountered along the plane during normal use. Most preferably, where the straps 16 are each presented as one discontinuous band, the loop patch 82 presents one continuous strip and is affixed to one surface of the strap, while the hook patch 80 is affixed to the opposite surface at one end. Where each of the straps 16 comprises two sections 66,68, the loop patch 82 coextensively covers the entire outer surface 78 of one of the sections, while the hook patch 80 is affixed to the other section on the inner surface 76 and adjacent the free end. One such hook and loop fastener is commercially available under the trademark "VELCRO" from the Velcro Industries B.V. LTD LIAB CO NETHERLANDS Castorweg 22–24 of Curacao NETHERLANDS. However, other conventional means of adjustably fastening the strap ends, including buckles, snaps, pins, clips and a combination thereof may be utilized.

As best shown in FIG. 1*a*, the goggle 10 preferably includes a semi-flexible air-tube stub 84 fixedly attached to the lens 12. More preferably, the stub 84 is attached to the front section 22 of the lens 12 near the top edge 34, so as not to obstruct the forward vision of the wearer. The preferred stub 84 presents an open generally tubular body having a circular cross-section, and open lower and upper stub ends 86,88. The stub 84 is coaxially aligned with an orifice defined by the lens 12, so that the open upper stub end 88 communicates with the now penetrated air-tight chamber 20. The lower stub end 86 preferably presents a cross-sectional diameter that is larger than the upper end 88 to present a tapered configuration. More preferably, the edge formed by the lower stub end 86 and the lens 12 is curved to present a funnel, so that energy loss associated with the orifice is reduced. Most preferably, the curvature presents a radius not less than one-sixteenths of an inch.

The stub 84 includes an externally threaded portion 92 adjacent the upper stub end 88, and a resultant non-threaded portion 94. The threaded portion 92 presents a threaded diameter equal to or less than the outer diameter of the non-threaded stub 84 portion, so that a ledge 96 is formed at the abutment therebetween. Preferably, the stub 84 is also transparent, and the stub 84 and lens 12 are integrally formed so as to present one unitary body.

An internally threaded stub cap 98 presenting an outer surface 100 is provided for sealably engaging the threaded portion 92 of the stub 84 and enclosing the open upper stub end 88, so that an air-tight chamber is again presented. The cap 98 presents a full width axial length that is slightly longer than the axial length of the threaded portion 92, so that the cap 98 when fully received contacts the ledge 96 and seals the open upper end 88. The outer surface 100 of the cap 98 is textured, i.e., knurled, serrated, etc., to present a non-slip surface that facilitates the tightening and removal of the cap 98, even where wet.

Figure 5:
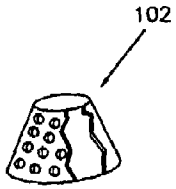
FIG. 5 is an enlarged perspective view of an embodiment of the filter cap.

Alternatively, the stub cap 98 can be pervious to air and preferably lined with at least one layer of filtrating material commonly known in the art, to form a filter cap 102 (see FIG. 5). It is appreciated that the filter cap 102 functions to prevent particulate matter, such as dust, from entering into the inner chamber 20. In this arrangement, the filter cap 102 may further include a complete layer of material capable of filtering biologically and/or chemically hazardous particulate matter.

As shown in FIG. 1*a*, a compressible seal ring 104 having an inner diameter that is less than the outer diameter of the non-threaded portion 94 is preferably provided adjacent the ledge 96. More preferably, the ring is formed of a non-reactive elastic rubber material and presents an inner diameter that is slightly smaller than the outer diameter of the stub 84 adjacent thereto, so that the ring snugly encircles the stub 84.

As best shown in FIG. 6, where the cap 98 is unattached to the air-tube stub 84, the threaded portion 92 of the stub 84 is able to sealably receive an internally threaded female end 106 of the air-tube 90. The female end 106 of the air-tube 90 presents a threaded length slightly longer than the length of the threaded portion 92 of the stub 84, so that the air-tube 90 abuts the ledge 96 when threadably received over the entire threaded portion 92 of the stub 84. More preferably, the seal ring 104 is interposed between the ledge 96 and female end 106 to further prevent the infiltration of fluid into the open upper end 88 of the stub 84. Finally, a retaining element (not shown) can be provided to prevent the unwanted detachment of the air-tube 90 from the stub 84.

The air-tube 90 also presents an upper male end 108 opposite the female end 106, and an enlarged portion 110 near the male end 108. The enlarged portion 110 presents a diameter that is not less than the outside diameter of the air-tube 90. More preferably, the enlarged portion 110 presents a spherical configuration having an outer diameter not less than one and one-quarter times the outer diameter of the air-tube 90. Alternatively, the male end 108 can be threaded consistently with the threaded portion 92 of the stub 84, so as to enable interconnection of multiple air-tubes, where desired. In this arrangement, the female end 106 of a second air-tube threadably engages the male end 108 of a first air-tube.

The air-tube 90 either singularly or conjointly presents an overall length that is not greater than the maximum depth at which the goggle 10 can be safely operated. More preferably, the length of the air-tube 90 is within the range of one to ten feet, and most preferably, between the range of three to five feet.

Figures 7, 7A:
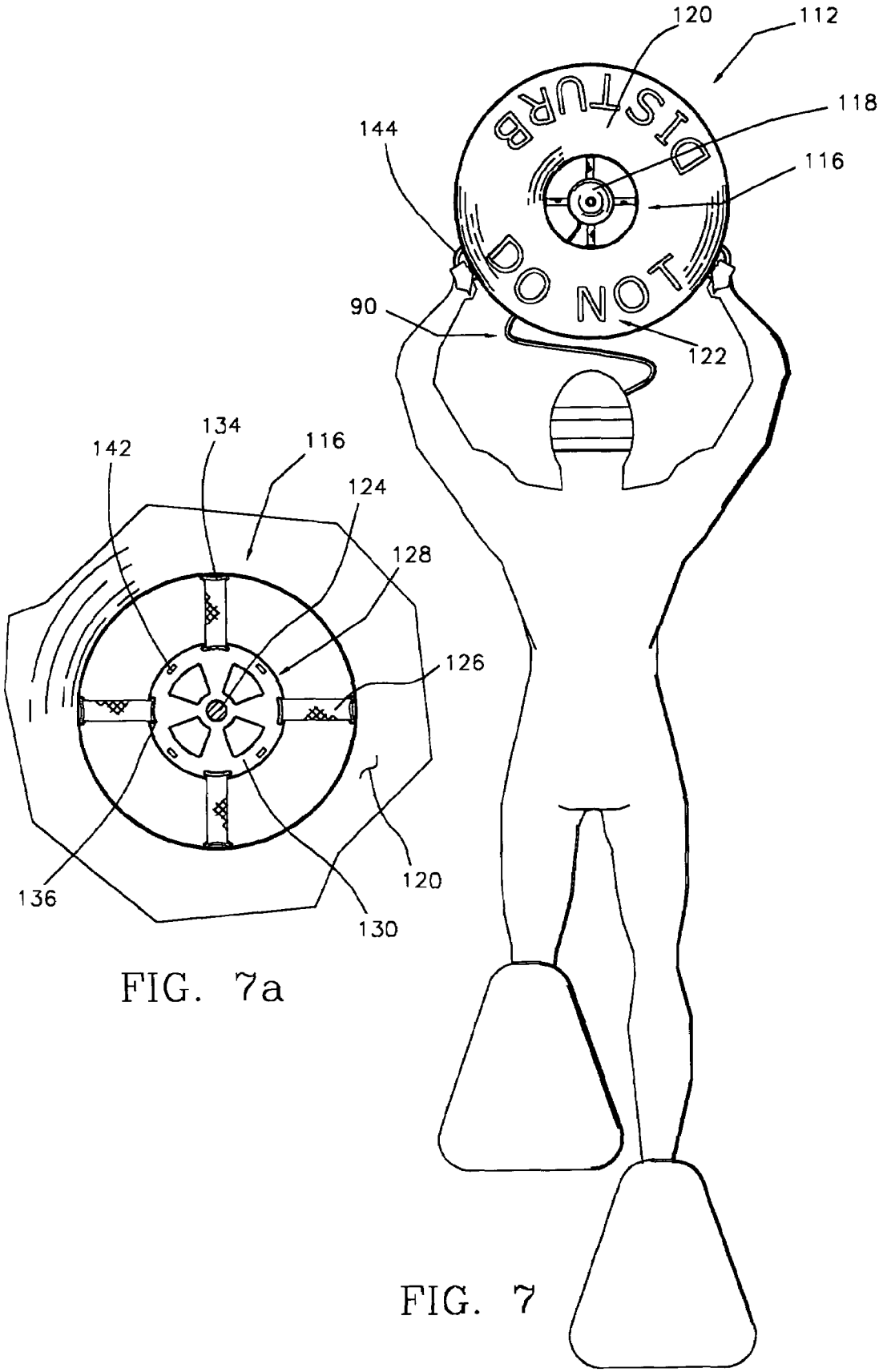
FIG. 7 is a plan view of the assembly shown in FIG. 6 being operated by the wearer.
FIG. 7*a* is a fragmentary planar view of the apparatus shown in FIG. 6, particularly illustrating the web.

Turning to FIGS. 6, 7 and 7*a*, the remote breathing apparatus 112 is shown coupled to the air-tube 90 adjacent the enlarged portion 110. The apparatus 112 functions to hold the upper end 108 of the air-tube 90 in a desired location or condition, i.e. above a water surface. The illustrated apparatus 112 includes a buoyant floatation device 114, a web 116 and a cover 118 connected to the web 116. It is within the purview of the invention, however, to utilize other devices for retaining the upper end 108 of the air-tube 90 in a desired location or condition. For example, an adjustable belt can be provided for coupling the air-tube 90 to a given object, such as an existing innertube or swimming pool rail. Other alternative devices include a suction for attaching to surfaces and a hook for engaging the upper edge of a panel.

The floatation device 114 includes an inflatable innertube 120. The inflatable innertube 120 is formed of a flexible lightweight membrane and presents a sealable orifice for inflating and deflating as is commonly known in the art. The membrane is capable of displaying water-insoluble images and indicia 122, such as "DO NOT DISTURB," or "SNORKEL MATE." When inflated, the innertube 120 presents a circular configuration having an outside diameter and an open space defined by an inside diameter. The innertube 120 further presents a circular cross-section when fully inflated. Alternatively, however, an elliptical cross-sectional shape on the bottom half of the innertube 120 can be provided, wherein the major axis radially extends through the center point of the innertube 120. It is appreciated by those skilled in the art that the elliptical configuration provides greater fluid displacement per incremental unit of depth.

The preferred innertube 120 presents an outside diameter within the range of about one to three feet and an inside diameter within the range of about four to eight inches. The inner and outer diameters are varied to present a buoyant force that is substantially greater than the anticipated submerging forces generated by the wearer under normal use. More preferably, the innertube 120 is sized to present a forgiving buoyant force that resistively signals to the wearer that the maximum operable depth has been reached, while offering some flexibility.

As best shown in FIG. 7*a*, the floatation device 114 also includes a rigidly flexible web 116 for coupling the upper end 108 of the air-tube 90 to the innertube 120 at a desired elevation above the water surface. The web 116 is preferably attached to the innertube 120 along a radially inner circle on the upper half of the innertube 120. The web 116 presents a predominantly open matrix and defines a central opening 124 that is slightly larger than the outside diameter of the air-tube 90 and smaller than the diameter of the enlarged portion 110 of the air-tube 90. The web 116 is preferably formed by a plurality of rigidly flexible bands 126 and a circular donut shaped disc 128 presenting upper and lower surfaces 130,132. The disc 128 preferably presents an outside diameter within the range of about two to four inches. The bands 126 are attached to the innertube 120 and disc 128 via a plurality of sleeves 134 securely affixed to the innertube 120 and a plurality of slots 136 defined by the disc 128. The bands 126 are formed of an elastic fabric that is capable of being increasingly stretched between the innertube 120 and disc 128 as the innertube 120 inflates. Each one of the bands 126 is, therefore, tensioned so as to present a rigidly flexible web 116 in the normal operating position. The bands 126 are able to further stretch to a maximum length, wherein the upper end of the air-tube 90 remains above the water surface. Thus, the resistive elasticity of the bands 126 also indicates to the wearer that the maximum depth has been reached.

As best shown in FIG. 6, preferably attached to the disc 128 on the upper surface 130 and near the outer edge is a rigid conical cover 118 for preventing splashed water from entering into the open upper end 108 of the air-tube 90. The vertical centerline of the preferred cover 118 is coaxially aligned with the central opening 124 defined by the web 116. Below the upper end 108 of the air-tube 90 a plurality of legs 138 emanate from the edge of the cover 118 to a point adjacent the outer edge of the disc 128. The lowermost edge of the cover 118 presents a circular cross section having a diameter equal to the outer diameter of the disc 128 so that the legs 138 are generally vertical. The legs 138 are spaced and the cover 118 is configured to allow sufficient airflow into the upper end of the tube. More preferably, the cover 118 is attached to the disc 128 via four legs 138 spaced apart at each quadrant of the disc 128. The web 116, disc 128, and cover 118 are all formed of a suitable rigid and water-insoluble material, such as plastic.

Figure 6A:
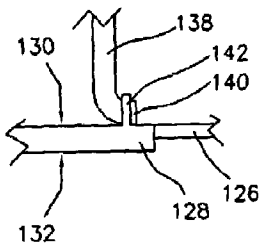
FIG. 6*a* is a fragmentary elevational view of the remote breathing apparatus, particularly illustrating a bent foot and bracket interconnection.

As typically shown in FIG. 6*a*, the preferred legs 138 and disc 128 are releasably connected, so that the cover 118 is removable. The lowermost point of each of the legs 138 presents a bent foot 140 projecting radially outward a foot length distance. The disc 128 at each connection point forms a bracket. Each bracket 142 has a side depth that is less than the foot length and defines a foot opening (not shown) having sufficient dimensions to receive the foot 140. More preferably, the foot length distance is one-eighths of an inch.

Finally, the preferred floatation device 114 includes at least one arcuately shaped handle that is permanently affixed to the innertube 120 along the outer circumference. More preferably, as shown in FIG. 7, a plurality of handles 144 is provided, wherein the handles 144 are spaced ninety-degree arc lengths apart.

In operation, the lower female end 106 of the air-tube 90 is passed through the central opening 124 of the web 116 with the upper disc surface 130 and brackets 142 facing upward. The air-tube 90 is pulled through the opening until the enlarged portion 110 is adjacent the disc 128. The cover 118 is then snapped into place, by inserting each foot 140 into one of the foot openings. The innertube 120 is then fully inflated to stretch the web 116 to the normal operating position shown in FIG. 6. The lower end of the air-tube 90 is screwed onto the stub 84 of the goggle, with the seal ring 104 in place, so that the seal ring 104 is compressed between the stub ledge 96 and air-tube 90. The goggle 10 is then donned, so that the top edge 34 of the lens 12 extends above the eyes and the bottom edge 36 extends below the nose of the wearer. The straps 16 are tightened around the head of the wearer to compress and conform the liner 14 to the contours of the wearer's face 18, so that a seal is formed between the lens 12 and the wearer's face 18.

As shown in FIG. 7, once the goggle 10 is donned and the floatation device 114 is properly attached, the wearer can view underwater environments at his or her leisure by gripping the handles 144 of the floatation device 114 and swimming in a generally freestyle position with his or her head at least partially submerged in the water. Finally, since the wearer's hands are not available for propulsion in this position, fins are preferably utilized.

The preferred forms of the invention and mode of operation described above are to be used as illustration only, and should not be utilized in a limiting sense in interpreting the scope of the present invention. Obvious modifications to the exemplary embodiments, as set forth herein, could be readily made by those skilled in the art without departing from the spirit of the present invention.

The inventor hereby states his intent to rely on the Doctrine of Equivalents to determine and assess the reasonably fair scope of the present invention as pertains to any apparatus 112 not materially departing from but outside the literal scope of the invention as set forth in the following claims.

I claim:

1. A periphery viewable goggle for protecting a portion of a wearer's face from externalities, wherein said portion includes the eyes and ears, said goggle comprising:

a flexible lens having transparent front, left and right sections, wherein said front section defines a lateral front length, and said left and right sections each extends transversely from the front section and presents a length not less than one-eighth of the lateral front length;

a compressible liner attached to the lens, and configured to form a seal between the lens and the wearer's face, when the goggle is donned; and a securing element for securing the lens in a fixed position relative to the wearer's face, and compressing the liner, so as to form an air-tight chamber between the lens and the portion of the wearer's face including the eyes and ears, when the goggle is donned.

2. The goggle as claimed in claim 1, said lens including a U-shaped liner interface presenting an inner surface, wherein said liner is adhesively attached to the inner surface.

3. The goggle as claimed in claim 1, said liner including an impervious outer layer and compressible material.

4. The goggle as claimed in claim 3, said compressible material being chosen from the group consisting essentially of gels, flowable rubber, foams, and sponges.

5. The goggle as claimed in claim 1, said securing element including at least one adjustable strap removably coupled to the lens.

6. The goggle as claimed in claim 5, said at least one strap comprising stretchable material.

7. The goggle as claimed in claim 6, said securing element including an adjustable fastener operable to fix the strap in one of a plurality of positions.

8. The goggle as claimed in claim 7, said fastener including a loop patch and a hook patch, said loop patch being operable to receive and hold the hook patch.

9. The goggle as claimed in claim 1, said lens presenting a half teardrop shaped vertical cross-section.

10. The goggle as claimed in claim 1, said liner being fluorescent.

11. The goggle as claimed in claim 1, said front, left and right sections being integrally formed, so as to present a unitary body.

12. The goggle as claimed in claim 1, said portion of the wearer's face including the nose, said lens defining an orifice;

an air-tube stub sealably attached to the lens and presenting a tubular body defining an open upper stub end, wherein said body is coaxially aligned with the orifice, so as to fluidly intercommunicate the airtight chamber and upper stub end; and a stub cap removably fastened to the upper stub end and operable to prevent the infiltration of fluid into the upper stub end.

13. The goggle as claimed in claim 12; and a filter cap removably fastenable to the open upper stub end, and configured to separate air from particulate air-borne matter.

14. The goggle as claimed in claim 1, further comprising:

a flexible air tube presenting a first open end that is sealably attached to the lens, an interior space, and a second open end opposite the first end; and a remote breathing apparatus coupled to the air tube at a location spaced from the first end, and configured to retain the second end of the tube in a generally fixed condition, said lens defining an orifice adjacent the interior space, so that said chamber is fluidly coupled to the second open end of the tube, when the goggle is donned.

15. The goggle as claimed in claim 14, wherein the apparatus includes a floatation device, and is configured to secure the second end of the tube above a water surface.

16. The goggle as claimed in claim 15, wherein the apparatus further includes a concave cover defining an interior space, and the second end of the tube is secured in a fixed position within the interior space.

* * * * *